US006368777B1

(12) United States Patent
Obuchowicz

(10) Patent No.: US 6,368,777 B1
(45) Date of Patent: Apr. 9, 2002

(54) PERFORMANCE OF PRINTING PLATES

(75) Inventor: Jacek Paul Obuchowicz, Mirfield (GB)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/249,123

(22) Filed: Feb. 12, 1999

(30) Foreign Application Priority Data

Feb. 13, 1998 (GB) ..... 9802973

(51) Int. Cl.[7] ..... G03C 5/00
(52) U.S. Cl. ..... 430/331; 430/302
(58) Field of Search ..... 430/302, 427, 430/432, 435, 331, 424

(56) References Cited

U.S. PATENT DOCUMENTS 3,696,746 A * 10/1972 Harper ..... 101/465
4,687,728 A * 8/1987 Folkard et al. ..... 430/270
4,780,396 A * 10/1988 Hsieh et al. ..... 430/331
4,880,555 A * 11/1989 Walls et al. ..... 252/143
5,002,857 A * 3/1991 Toyama et al. ..... 430/300
5,292,626 A * 3/1994 Buhr et al. ..... 430/331
5,409,803 A * 4/1995 Santos et al. ..... 430/331
5,766,826 A * 6/1998 Miller et al. ..... 430/331
5,807,658 A * 9/1998 Ellis et al. ..... 430/302

FOREIGN PATENT DOCUMENTS

EP 514 145 * 11/1992
EP 599 510 * 6/1994

* cited by examiner

*Primary Examiner*—Janet Baxter
*Assistant Examiner*—Barbara Gilmore
(74) *Attorney, Agent, or Firm*—Breiner & Breiner, L.L.C.

(57) ABSTRACT

A finishing solution is provided for application to thermally sensitive printing plates wherein image formation requires at least partial coalescence of particles within the imaging layer. The finishing solution includes a coalescing aid which comprises a solvent or mixture of solvents having solubility characteristics which facilitate softening or solubilization of the disperse phase and the continuous phase of the radiation sensitive coating of the plate, thereby allowing phase separation and reticulation to be avoided. A method of image formation is also disclosed.

34 Claims, No Drawings

PERFORMANCE OF PRINTING PLATES

This invention relates to printing plates and is concerned with the improvement of plate performance and with a treatment solution for achieving said improvement.

Lithographic printing is a process of printing from surfaces which have been prepared in such a way that certain areas are capable of accepting ink (oleophilic areas), whereas other areas will not accept ink (oleophobic areas). The oleophilic areas form the printing areas while the oleophobic areas form the background areas.

Plates for use in lithographic printing processes may be prepared using a photographic material that is made imagewise receptive or repellent to ink upon photo-exposure of the photographic material and subsequent chemical treatment. However, this method of preparation, which is based on photographic processing techniques, involves several steps, and therefore requires a considerable amount of time, effort and expense.

Consequently it has, for many years, been a long term aim in the printing industry to form images directly from an electronically composed digital database, ie by a so-called "computer-to-plate" system. The advantages of such a system over the traditional methods of making printing plates are:

(i) the elimination of costly intermediate silver film and processing chemicals;

(ii) a saving of time; and iii) the ability to automate the system with consequent reduction in labour costs.

The introduction of laser technology provided the first opportunity to form an image directly on a printing plate precursor by directing a laser beam at sequential areas of the plate precursor and modulating the beam so as to vary its intensity. In this way, radiation sensitive plates comprising a high sensitivity photocrosslinkable polymer have been exposed with water-cooled UV argon-ion lasers and electrophotographic plates having sensitivity stretching from the visible spectral region into the near infra-red region have been successfully exposed using low-powered air-cooled argon-ion and semiconductor laser devices.

Imaging systems are also available which involve a sandwich structure which, on exposure to a heat generating infra-red laser beam, undergoes selective (imagewise) delamination and a subsequent transfer of materials. Such so-called peel-apart systems are generally used as replacements for silver halide films.

The present applicants have previously disclosed, in EP-A-514,145 a method of image formation which comprises: providing a radiation sensitive plate comprising a substrate and a coating containing a heat softenable disperse phase, an aqueous soluble or swellable continuous phase and a radiation absorbing substance; Eimagewise exposing the plate to at least partially coalesce the particles of the disperse phase in the image areas; and developing the imagewise exposed plate to remove the coating in the unexposed areas. The directly imaged plates thus obtained may then be used to provide printed images in the normal way using a conventional printing press.

The plates obtained in this way, however, were found to have rather poor durability in printing operations; in particular, they suffered from poor run length on the press. This drawback was believed to be associated with the fact that the at least partial coalescence of the particles of the disperse phase which occurred during imagewise exposure involved a purely physical mixing process. Consequently, it was concluded that more satisfactory performance would be achieved by the use of a system in which new chemical bond formation could be induced in image areas of the plates prior to their use on a printing press, thus providing a greater image toughness and durability.

Accordingly, EP-B-599,510 teaches a method of image formation as previously disclosed in EP-A-514,145, but which additionally comprises the step of heating the developed plate or subjecting it to irradiation to effect insolubilization of the image. In this way, good quality images of high durability are obtained.

Such insolubilization is brought about by chemical reaction between one or more of the components of the coating, which occurs as a result of the heating or irradiation treatment. In order to facilitate such chemical interactions, it is necessary that at least one of the heat softenable disperse phase and the aqueous soluble or swellable continuous phase should include a chemically reactive grouping or precursor therefor.

Despite the improvements which have been effected in this way, however, some further difficulties have been experienced with plates of the type disclosed in EP-B-599,510. In particular, the very short exposure times associated with laser imaging techniques inevitably mean that it is extremely difficult to achieve uniform heating throughout the coating, since the film surface is heated substantially more than those regions well below the surface. As a consequence, surface overheating can occur, causing damage to, or ablation of, the surface material. As well as leading to poor image formation, weak images and potentially impaired press performance, such overheating may also give rise to a plume of ablated debris and pyrolysis products that can attenuate and deflect the imaging laser beam.

Consequently, a system has been disclosed in United Kingdom patent application No. 9709404.9 wherein radiation sensitive plates of this type are provided with an additional, topmost covering layer, said layer having, at the chosen wavelength of exposure, an optical density which is lower than that of the imaging layer. Plates incorporating such a topmost layer achieve more uniform heating through the coating and thereby overcome the difficulties associated with surface overheating; thus, it is possible to obtain improvements in terms of run length, solvent resistance, handleability and scratch resistance.

Surprisingly, however, it has now been found that yet further significant improvements in press life may be achieved by treatment of the imaged plates, prior to post-development baking, with a suitable finishing solution which further enhances coalescence of the particles in the coating.

According to the present invention, there is provided a finishing solution for application to a thermally sensitive printing plate having an imaging layer including particles which are required at least partially to coalesce to form an image, said finishing solution comprising a coalescing aid.

The coalescing aid for use in the finishing solution of the present invention, wherein said plate has a radiation sensitive coating including a disperse phase and a continuous phase, comprises a solvent or mixture of solvents having solubility characteristics which facilitate softening or insolubilization of both said phases, thereby allowing phase separation and reticulation to be avoided. The solubility characteristics may be conveniently expressed in terms of Hansen solubility parameters. Typically, suitable Hansen solubility parameters would fall in the ranges $\delta d$ (dispersion)=7.0–9.8, $\delta p$ (polar)=1.5–8.8 and $\delta h$ (hydrogen bonding)=1.7–5.2 but, for any given solvent, one or more of the parameters may fall outside the specific ranges.

The coalescing aid should also have a boiling point in excess of 250° C., preferably in excess of 300° C., in order that its total evaporation during the baking of the plate should be avoided.

Preferably, the solvent or solvent mixture which is present in the coalescing aid comprises a ketone, e.g. γ-butyrolactone or isophorone, an organic carbonate, for example ethylene carbonate or propylene carbonate, an alcohol such as glycerol or diethylene glycol, a hydrocarbon, e.g. 1,2,3,4-tetrahydronaphthalene (available commercially from E.I. du Pont de Nemours and Company as Tetralin®), or a dibasic ester of a dicarboxylic acid, most preferably an aliphatic dicarboxylic acid. Suitable aliphatic carboxylic acids are those containing lower alkyl—preferably $C_{26}$ alkyl—chains, for example succinic, glutaric and adipic acids. Particularly infavorable results are achieved with the dimethyl, diethyl and dipropyl esters of these acids, and their mixtures. Of most interest in this regard is a mixture of the dimethyl esters of succinic, glutaric and adipic acids, specifically a mixture of dimethyl glutarate (61–67%), dimethyl succinate (20–26%) and dimethyl adipate (13–19%), which is commercially available as DuPont®DBE or Imasol®R.

The coalescing aid is advantageously applied to the printing plate in combination with a finishing solution, following exposure and development. Preferably, the coalescing aid is included in the finisher at a level of 0.1 to 5% w/w, most preferably 0.5 to 1% w/w.

The finishing solution typically comprises an aqueous solution containing desensitizers, etching agents and surfactants, and optionally including other additives such as sequestering agents, plasticizers and biocides.

Desensitizers are present in an amount of from 2–10% w/w, preferably from 4 to 7.5% w/w, and serve to prevent sensitization from occurring in background non-image areas, thereby avoiding ink acceptance in these areas, which can otherwise give rise to unsatisfactory prints. Typical desensitizers include sodium gluconate and sodium hexametaphosphate (available commercially as Calgon®R) and tripotassium citrate.

Cleanliness in background non-image areas, with a consequent avoidance of unwanted ink acceptance and the resulting potential for producing dirty and unsatisfactory prints, is enhanced by the incorporation of an etching agent, such as tartaric acid, in an amount of from 0.2% to 5% w/w, preferably from 0.5% to 2.5% w/w. The etching agent serves to etch the surface of an anodized layer on the substrate, thereby presenting a fresh surface, free from contamination, during printing operations.

Various surfactants, most particularly anionic surfactants, may be incorporated in the compositions and can serve as wetting agents, to enhance the hydrophilicity of non-image areas or, on occasions, as oleophilizers, improving ink acceptance in image areas. Typical anionic surfactants include, for example, sodium diisopropyl-naphthalene sulphonate (available commercially as Rhodacal®BA77), sodium 2-ethylhexyl sulphonate (available commercially as Surfac EH40) and the sodium salt of naphthalene sulphonic acid-formaldehyde polycondensate (available commercially as Tamol®7718), and the materials may be present at a level of from 0.1% to 10% w/w, preferably 0.5% to 5% w/w.

Sequestering agents, for example tetrasodium ethylenediaminetetraacetic acid, or glucoheptanoate may be present in an amount of from 0.05% to 2% w/w, preferably from 0.1% to 1% w/w; suitable plasticizers, which may be added at a level of from 0.5% to 10% w/w, preferably from 1% to 5% w/w, include glycerine; and any suitable commercial biocide, such as Bactrachem®BF2, may be incorporated in an amount of from 0.05% to 2.5% w/w, preferably from 0.1% to 1% w/w. Radiation sensitive plates which may be treated with the finishing solution of the present invention are thermally imaged plates comprising a substrate and an imaging layer, wherein the imaging layer comprises particles which are required to at least partially coalesce to form an image. Said plates are preferably of the type disclosed in EP-B-599510, wherein the imaging layer comprises:

(i) a layer comprising
  (a) a disperse phase comprising a water-insoluble heat-softenable component and
  (b) a binder or continuous phase comprising a component which is soluble or swellable in aqueous, preferably aqueous alkaline, medium, at least one of the components including a reactive grouping; and
(ii) a substance capable of strongly absorbing radiation to produce heat.

Exposure of such plates to radiation causes at least partial coalescence of the particles in the layer in the exposed areas, thereby forming an image which, due to the presence of the reactive grouping, undergoes insolubilization at elevated temperature and/or exposure to radiation.

Most preferably, plates of the type disclosed in United Kingdom patent application No. 9709404.9 may be treated with the finishing solution of the present invention and produce particularly favorable results. Such plates are essentially of the type previously disclosed in EP-B-599510, but additionally include a topmost covering layer having, at the chosen wavelength of exposure, an optical density which is lower than that of the imaging layer.

The material used for the substrate depends upon the purpose for which the image is to be used and may be, for example, a metal or a plastics material. In the case where the image is to be used as a printing image, the substrate is preferably aluminum, most preferably electrochemically roughened aluminum which includes a surface anodic oxide layer.

The imaging layer may be formed on the substrate using either aqueous or non-aqueous vehicles, or mixtures thereof, in order to obtain a radiation sensitive plate. The imaging layer is preferably coated on to the substrate at a coating weight of 0.1 to 5 $g/m^2$ most preferably 0.8 to 1.2 $g/m^2$ When it is included, the topmost covering layer may be subsequently coated over the imaging layer using an aqueous, optionally aqueous alkaline, medium to give a layer having a preferred coating weight of 0.01 to 5 $g/m^2$, most preferably 0.1 to 1$g/m^2$ According to another aspect of the present invention, there is provided a method of forming an image which comprises:

(a) providing a radiation sensitive plate as hereinbefore described;
(b) imagewise exposing the radiation sensitive plate to a beam of high intensity radiation by directing the radiation at sequential areas of the coating and modulating the radiation so that the particles in the imaging layer are selectively at least partially coalesced;
(c) developing the imagewise exposed plate with aqueous medium to selectively remove the areas containing the non-coalesced particles and leave an image on the substrate resulting from the at least partially coalesced particles;
(d) treating the developed plate with a finishing solution according to the present invention; and
(e) heating the finished plate and/or subjecting it to actinic radiation to effect insolubilization.

In a particular embodiment of the invention, the source of the high intensity radiation is a laser operating in the ultra-violet, visible or infra-red region of the spectrum. Red and infra-red light emitting lasers are typically used, for example the semiconductor or diode lasers, typical of which is the gallium aluminum arsenide laser which operates in the 750–870 nm region, and neodymium—YAG lasers which operate around 1064 nm.

Preferred developers for selectively removing the non-coalesced material in the non-image areas are aqueous alkalis, such as solutions of ethanolamine and sodium metasilicate, an alkaline phosphate such as trisodium phosphate, or an alkali metal hydroxide in water.

Plates treated prior to baking with the finishing solution of the present invention show improved press performance, in terms of run length and image definition, and are also characterized by greater solvent resistance, increased durability of highlights on press and increased crosslink density following the baking step. In addition, image formation requires a lower energy of exposure than in the case of plates treated with the finishing solutions of the prior art, and the conditions required during the post-finishing baking treatment are less stringent, in terms of both temperature and time, resulting, in each case, in significant cost savings.

The following examples are, without limitation, illustrative of the invention.

EXAMPLES

Example 1

This example illustrates the improved run length and increased durability of highlights on press which are associated with the invention.

50 g of a 12% w/w solids content coating mixture was prepared as follows: 14.2 g of a pigment dispersion P1 prepared by milling 1.09 g of Degussa®FW2V (a carbon black pigment) with 1.33 g of Carboset 525 (an acrylic copolymer available from BF Goodrich) in 2.71 g of isopropanol and 8.96 g of distilled water containing 0.14 g of aqueous ammonia (S.G 0.880) was stirred with 3.8 g of a solution of 0.3 g Carboset 525 in 0.8 g of isopropanol and 2.66 g of distilled water containing 0.03 g of aqueous ammonia (S.G. 0.880) and 3.8 g isopropanol was added. 15.2 g of a polymer latex was stirred with 13ml of distilled water and the resultant mixture was added dropwise, with stirring, to the above dispersion. When the addition was complete, the quality of the coating material obtained was verified by means of an optical microscope to ensure high dispersion quality. The material was then coated on to a grained and anodized aluminum substrate to give a coat weight of 0.9 g/m$^2$ A topcoat formulation was prepared by dissolving 3.4 g of Carboset 525 in 46.1 g of distilled water and 0.5 g ammonia (S.G. 0.880). The topcoat was applied to the coated plate to give an overcoat weight of 0. g/m2.

The plate was exposed by an array of laser diodes at a nominal 10 micron beam, giving an exposure of 210 mJ/cm$^2$, to effect at least partial coalescence of the particles in the radiation struck areas.

A very high quality image was obtained following development in a sodium metasilicate based developer (Unidev®, from DuPont Printing and Publishing) to remove the non-coalesced areas of the coating.

A finishing solution was formulated from the following components:

| | |
|---|---|
| Sodium Gluconate | 50 g |
| Sodium Hexametaphosphate (available as Calgon PT) | 5 g |
| Sodium 2-Ethylhexyl sulphonate (aqueous solution) (available as Surfac EH40) | 100 ml |
| DuPont DBE | 5 ml |
| Tartaric Acid | 10 g |
| Demineralized Water | to 1000 ml |

The formulation has SG 1.045 to 1.052 and pH 3.5 to 4.0 at 20° C.

The developed plate was treated with this finishing solution to facilitate complete coalescence of the coating in the image areas, and then baked in a travelling oven at 280° C. for one minute. The resulting plate showed good resistance to solvents and gave increased numbers of copies and improved strength of highlight dot on a web offset press when compared with a plate finished with a conventional finisher lacking a coalescing aid. The plate also showed excellent storage stability.

Example 2

This example illustrates the lower exposure energy which is required as a result of the invention.

A grained and anodized aluminum substrate was coated with a 12% w/w solids coating composition and topcoated with a 7% w/w solids topcoating composition as described in Example 1.

The resulting plate was exposed by an array of laser diodes at a nominal 10 micron beam, giving an exposure of 180 mJ/cm$^2$, to effect at least partial coalescence of the particles in the radiation struck areas, sufficient to resist development.

A very high quality image was obtained after development in an aqueous sodium hydroxide based developer (containing, for example, 0.5% w/v sodium hydroxide and 15–20% w/v surfactant) to remove the non-coalesced areas of the coating.

A finishing solution was formulated from the following components:

| | |
|---|---|
| Sodium Gluconate | 50 g |
| Sodium Hexametaphosphate (available as Calgon PT) | 10 g |
| Tetrasodium Ethylenediaminetetraacetic acid | 4 g |
| Sodium Diisopropylnaphthalene sulphonate (aqueous solution) (available as Rhodacal BA77) | 20 g |
| Glycerine | 20 ml |
| DuPont DBE | 5.29 g |
| Tartaric Acid | 20 g |
| Bactrachem BF2 | 2 ml |
| Demineralized Water | to 1000 ml |

The formulation has SG 1.054 to 1.058 and pH 3.4 to 4.0 at 20° C.

The developed plate was treated with this finishing solution to facilitate complete coalescence of the coating in the image areas, and then baked in a travelling oven at 280° C. for one minute to effect complete crosslinking of the image.

Despite the lower energy of exposure employed when compared with Example 1, the present plate showed improved resistance to solvents and gave increased numbers of copies on a web offset press in comparison to a plate finished with a conventional finisher lacking a coalescing aid.

Example 3

This example illustrates the lower post development baking requirements which are associated with the invention.

A grained and anodized aluminum substrate was coated with a 12% w/w solids coating composition and topcoated with a 7% w/w solids topcoating composition as described in Example 1.

The resulting plate was exposed by an array of laser diodes at a nominal 10 micron beam, giving an exposure of 210 mJ/cm$^2$, to effect at least partial coalescence of the particles in the radiation struck areas.

A very high quality image was obtained after development in a sodium metasilicate based developer (Unidev, from DuPont Printing and Publishing) to remove the non-coalesced areas of the coating.

A finishing solution was formulated from the following components:

| | |
|---|---|
| Sodium Gluconate | 50 g |
| Sodium Hexametaphosphate (available as Calgon PT) | 5 g |
| Sodium 2-Ethylhexyl sulphonate (aqueous solution) (available as Surfac EH40) | 100 ml |
| γ-Butyrolactone | 5 ml |
| Tartaric acid | 10 g |
| Demineralized water | to 1000 ml |

The formulation has SG 1.045 to 1.052 and pH 3.5 to 4.0 at 20° C.

The developed plate was treated with this finishing solution to facilitate complete coalescence of the coating in the image areas, and then baked in a travelling oven at 220° C. for 30 seconds to effect complete crosslinking of the image.

Despite the less stringent baking conditions when compared with Examples 1, 2 and 4 the present plate showed improved durability during printing operations carried out on a web-offset press in comparison to a plate finished with a conventional finisher lacking a coalescing aid.

Example 4

This example illustrates the improved run length and increased crosslink density—evidenced by the enhanced solvent resistance—which are associated with the invention.

A grained and anodized aluminum substrate was coated with a 12% w/w solids coating composition and topcoated with a 7% w/w solids topcoating composition as described in Example 1.

The resulting plate was exposed by a modulated beam from a Nd/YAG laser at a nominal 10 micron beam, giving an exposure of 170 mJ/cm$^2$, to effect at least partial coalescence of the particles in the radiation struck areas.

A very high quality image was obtained after development in an aqueous sodium hydroxide based developer of the type referred to in Example 2 to remove the non-coalesced areas of the coating.

A finishing solution was prepared by making additions of Tamol 7718 (50 g) and Merpol®A (alkyl phosphate ethoxylate surfactant) (0.1 ml) to the finishing solution detailed in Example 2.

The developed plate was treated with this finishing solution to facilitate complete coalescence of the coating in the image areas, and then baked in a travelling oven at 280° C. for one minute to effect complete crosslinking of the image.

The resulting plate showed improved resistance to solvents and gave increased numbers of copies on a web offset press compared with a plate finished with a conventional finisher which did not include a coalescing aid. The improved performance was attributed to the coalescence achieved prior to baking.

What is claimed is:

1. A finishing solution for application to a thermally sensitive printing plate having an imaging layer comprising a radiation sensitive coating including particles which are required at least partially to coalesce to form an image, the coating including a disperse phase and a continuous phase, said finishing solution comprising a coalescing aid which comprises a solvent or mixture of solvents having solubility characteristics which facilitate softening or solubilization of both said disperse phase and said continuous phase, at least one of the Hansen solubility parameters of said coalescing aid falling within the ranges δd (dispersion)=7.0–9.8, δp (polar)=1.5–8.8 and δh (hydrogen bonding)=1.7–5.2, and said solvent or mixture of solvents includes a ketone comprising γ-butyrolactone or isophorone.

2. A finishing solution as defined in claim 1 wherein said coalescing aid has a boiling point in excess of 250° C.

3. A finishing solution as defined in claim 2 wherein said boiling point is in excess of 300° C.

4. A finishing solution as defined in claim 1 wherein said solvent or said solvent mixture further comprises at least one of an organic carbonate, an alcohol, a hydrocarbon or a dibasic ester of a dicarboxylic acid.

5. A finishing solution as defined in claim 4 wherein said solvent includes said alcohol and said alcohol comprises glycerol or diethylene glycol.

6. A finishing solution as defined in claim 4 wherein said solvent includes said hydrocarbon and said hydrocarbon comprises 1,2,3,4-tetrahydronaphthalene.

7. A finishing solution as defined in claim 4 wherein said solvent includes said dibasic ester of a dicarboxylic acid and said dibasic ester of a dicarboxylic acid comprises at least one dibasic ester of an aliphatic dicarboxylic acid.

8. A finishing solution as defined in claim 7 wherein said aliphatic dicarboxylic acid is an alkyl dicarboxylic acid containing lower alkyl chains.

9. A finishing solution as defined in claim 8 wherein said lower alkyl chains are $C_{2-6}$ alkyl chains.

10. A finishing solution as defined in claim 7 wherein said dibasic ester of a dicarboxylic acid comprises a dibasic ester of succinic, glutaric or adipic acid.

11. A finishing solution as defined in claim 10 wherein said dibasic ester comprises the dimethyl, diethyl or dipropyl ester.

12. A finishing solution as defined in claim 11 wherein said dibasic ester comprises a mixture of the dimethyl esters of succinic, glutaric and adipic acids.

13. A finishing solution as defined in claim 1 wherein said coalescing aid is present at a level of from 0.1 to 5% w/w.

14. A finishing solution as defined in claim 13 wherein said coalescing aid is present at a level of from 0.5 to 1% w/w.

15. A finishing solution as defined in claim 1 wherein said solution comprises an aqueous solution containing at least one of a desensitizer, an etching agent and a surfactant.

16. A finishing solution as defined in claim 15 wherein said solution includes said desensitizer and said desensitizer comprises sodium gluconate, sodium hexametaphosphate or tripotassium citrate and is present in an amount of from 2–10% w/w.

17. A finishing solution as defined in claim 15 wherein said solution includes said etching agent and said etching agent comprises tartaric acid and is present in an amount of from 0.2% to 5% w/w.

18. A finishing solution as defined in claim 15 wherein said solution includes said surfactant and said surfactant comprises an anionic surfactant.

19. A finishing solution as defined in claim 18 wherein said anionic surfactant comprises sodium diisopropylnaphthalene sulphonate, sodium 2-ethylhexyl sulphonate or the sodium salt of naphthalene sulphonic acid-formaldehyde polycondensate and is present at a level of from 0.1% to 10% w/w.

20. A finishing solution as defined in claim 15 wherein said solution additionally comprises at least one of a sequestering agent, a plasticizer and a biocide.

21. A finishing solution as defined in claim 20 wherein said solution includes said sequestering agent and said sequestering agent comprises tetrasodium ethylenediaminetetraacetic acid and is present in an amount of from 0.05% to 2% w/w.

22. A finishing solution as defined in claim 20 wherein said solution includes said plasticizer and said plasticizer comprises glycerine and is present at a level of from 0.5% to 10% w/w.

23. A finishing solution as defined in claim 20 wherein said solution includes said biocide and said biocide is present in an amount of from 0.05% to 2.5% w/w.

24. A finishing solution for application to a thermally sensitive printing plate having an imaging layer comprising a radiation sensitive coating including particles which are required at least partially to coalesce to form an image, the coating including a disperse phase and a continuous phase, said finishing solution comprising a coalescing aid which comprises a solvent or mixture of solvents having solubility characteristics which facilitate softening or solubilization of both said disperse phase and said continuous phase, at least one of the Hansen solubility parameters of said coalescing aid falling within the ranges δd (dispersion)=7.0–9.8, δp (polar)=1.5–8.8 and δh (hydrogen bonding)=1.7–5.2, and said solvent or mixture of solvents includes an organic carbonate and said organic carbonate comprises ethylene carbonate or propylene carbonate.

25. A finishing solution for application to a thermally sensitive printing plate having an imaging layer comprising a radiation sensitive coating including particles which are required at least partially to coalesce to form an image, the coating including a disperse phase and a continuous phase, said finishing solution comprising a coalescing aid which comprises a mixture of solvents having solubility characteristics which facilitate softening or solubilization of both said disperse phase and said continuous phase, at least one of the Hansen solubility parameters of said coalescing aid falling within the ranges δd (dispersion)=7.0–9.8, δp (polar)=1.5–8.8 and δh (hydrogen bonding)=1.7–5.2, and said mixture of solvents comprises 61–67% dimethyl glutarate, 20–26% dimethyl succinate and 13–19% dimethyl adipate.

26. A method of image formation which comprises:

(A) providing a radiation sensitive plate comprising a substrate and an imaging layer comprising a radiation sensitive coating including particles which are required at least partially to coalesce to form an image, the coating including a disperse phase and a continuous phase;

(B) imagewise exposing the radiation sensitive plate to a beam of high intensity radiation by directing the radiation at sequential areas of the imaging layer and modulating the radiation so that the particles in said coating are selectively at least partially coalesced;

(C) developing the imagewise exposed plate with aqueous medium to selectively remove the areas containing non-coalesced particles and leave an image on the substrate resulting from the at least partially coalesced particles;

(D) treating the developed plate with a finishing solution as defined in any preceding claim; and (E) heating the finished plate and/or subjecting it to actinic radiation to effect insolubilization.

27. A method of image formation as defined in claim 26 wherein said radiation sensitive plate includes an imaging layer which comprises:

(i) a layer comprising:

(a) a disperse phase comprising a water-insoluble heat-softenable component; and (b) a binder or continuous phase comprising a component which is soluble or swellable in aqueous, preferably aqueous alkaline, medium, at least one of the components including a reactive grouping; and (ii) a substance capable of strongly absorbing radiation to produce heat.

28. A method of image formation as defined in claim 26 wherein said radiation sensitive plate additionally includes a topmost covering layer having at the chosen wavelength of exposure an optical density which is lower than that of the imaging layer.

29. A method of image formation as defined in claim 28 wherein said top most covering layer is coated over the imaging layer at a coating weight of from 0.01 to 5 $g/m^2$.

30. A method of image formation as defined in claim 26 wherein said substrate comprises a metal or a plastics material.

31. A method of image formation as defined in claim 30 wherein said metal comprises electrochemically roughened aluminum which includes a surface anodic oxide layer.

32. A method of image formation as defined in claim 26 wherein said imaging layer is coated on to the substrate at a coating weight of from 0.1 to 5 $g/m^2$.

33. A method of image formation as defined in claim 26 wherein said high intensity radiation is provided by a laser operating in the ultra-violet, visible or infra-red region of the spectrum.

34. A method of image formation as defined in claim 26 wherein said aqueous medium for developing the imagewise exposed plate comprises an aqueous alkali.

* * * * *